United States Patent [19]

Wise et al.

[11] Patent Number: 4,582,359

[45] Date of Patent: Apr. 15, 1986

[54] ONE-HANDED HIGH CHAIR TRAY RELEASE MECHANISM

[75] Inventors: Robert D. Wise, Akron; Robert L. Quinlan, Jr., Barberton; Charles W. Lauro, Akron, all of Ohio

[73] Assignee: Gerber Products Company, Fremont, Mich.

[21] Appl. No.: 711,708

[22] Filed: Mar. 13, 1985

[51] Int. Cl.[4] ..... A47B 83/02

[52] U.S. Cl. ..... 297/151; 297/153

[58] Field of Search ..... 297/151, 154, 153, 150; 248/429, 430

[56] References Cited

U.S. PATENT DOCUMENTS

| | | | |
|---|---|---|---|
| 2,100,546 | 11/1937 | Kramer | 248/429 |
| 2,118,509 | 5/1938 | Heinritz | 297/151 |
| 2,154,294 | 4/1939 | Whedon | 248/429 |
| 2,505,490 | 1/1947 | Greenbaum . | |
| 3,476,435 | 11/1969 | Hitzelberger | 248/429 |
| 3,490,808 | 1/1970 | Siegel | 297/151 |
| 4,151,973 | 5/1979 | Sedlock | 248/429 |
| 4,288,123 | 9/1981 | Cone . | |

FOREIGN PATENT DOCUMENTS

| | | | |
|---|---|---|---|
| 171264 | 11/1921 | United Kingdom | 297/153 |

*Primary Examiner*—Francis K. Zugel

*Attorney, Agent, or Firm*—Townsend and Townsend

[57] ABSTRACT

A one-hand operable high chair tray release mechanism is provided with a handle that simultaneously releases pegs that secure cuffs located beneath the tray to the arms of a high chair via mating openings in the chair arms and cuffs. The pegs translate horizontally and are spring biased to maintain the tray secured to the arms of the high chair tray.

7 Claims, 4 Drawing Figures

ONE-HANDED HIGH CHAIR TRAY RELEASE MECHANISM

This invention relates to a high chair tray release mechanism for attaching a tray to a high chair. This simplified mechanism can be operated with one hand, is endowed with superior safety features, minimizes the number of moving parts, and is inexpensive to fabricate, resulting in a lower cost for an improved product.

BACKGROUND OF THE INVENTION

A number of mechanisms for releasing high chair trays from their high chairs have been proposed. Examples of such mechanisms are disclosed in U.S. Pat. No. 2,505,490 to Greenbaum and U.S. Pat. No. 4,288,123 to Cone. In general, these mechanisms address the desirable feature of removing a high chair tray from a high chair with one hand, while leaving the other hand free to carry the infant or child to be seated in the high chair. In order for the mechanism to be effective and efficient, the tray must provide a stable surface on which food and toys can be placed, the tray should be sufficiently secured to the chair such that the child's weight against the tray cannot inadvertently release the tray from the chair. For the sake of safety, the mechanism should not present any sharp edges or any connections where the child's legs could be injured while the child is seated within the chair.

High chairs are primarily used to seat an infant or child too small to be seated in conventional chairs for feeding. By definition, high chair trays are designed to contain any food which may not successfully end up within the infant. For this reason, trays must be cleaned often. Also, the tray should be stable enough to prevent any tipping that would overturn dishes and food.

These and other problems are addressed by the present invention.

The particular features of the invention will become apparent from the following description when taken in cojunction with the drawings.

SUMMARY OF THE INVENTION

The mechanism of the invention is designed to removably secure a tray to a high chair. Two cuffs are mounted on the underside of the tray to engage the arms of the high chair. Each arm of the high chair are provided with a series of holes along its length. The cuffs each have at least one hole to mate with the holes in the arms of the chair. The two cuffs are connected with a peg arm which is connected at its ends to pegs which fit sequentially through the hole in each cuff and a hole in each arm of the chair. At one side of the tray, a handle is provided which extends from a pivot point in the cuff located on that side of the tray. The handle in the closed position pushes the pegs located on the arm through the holes provided in their respective cuffs and the holes in the arms of the chair. When the handle is extended, the pegs are completely withdrawn from the holes in the arms of the chair allowing the tray to be disengaged completely from the chair. The handle is biased to remain in the closed position.

The high chair tray of the invention remains safely secured to the high chair until the handle is pulled open. Since the pegs are both connected to the handle by the peg arm, only one hand is needed to pull open the handle to simultaneously release both cuffs from the arms of the high chair. Cleaning of the tray is facilitated by this invention, since the tray can be completely removed from the chair. The cuffs are of sufficient length so that the tray is prevented from tipping while on the chair. The release mechanism is also constructed of a minimum number of moving parts, and is inexpensive to fabricate. Only a series of holes is provided in the arms of the high chair. No sharp edges or teeth that could pose a danger to the child are present. Because the handle and release mechanism are placed along the underside of the tray, there is little chance that the child will inadvertently remove the tray from its closed position. The slight horizontal movement of the peg arm minimizes the danger of pinching the child's legs while the child is seated in the high chair.

DETAILED DESCRIPTION OF THE INVENTION

Figure 1:
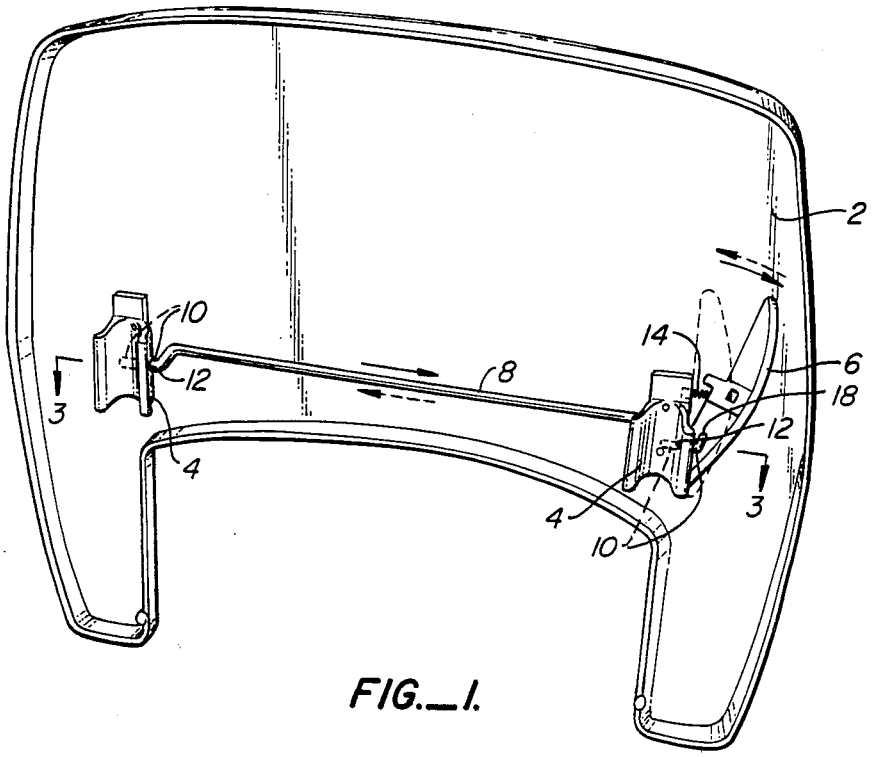
FIG. 1 illustrates the underside of the high chair tray, revealing the release mechanism in perspective.

FIG. 1 is a perspective illustration of the underside of the tray 2. The pair of cuffs 4 which engage the arms of the high chair are disposed in parallel positions under the tray. The handle 6 by which the release mechanism is activated is provided along one side of the tray.

In the simple embodiment of the invention shown in FIG. 1, a single peg arm 8 provides the pair of pegs 10 which fit through the holes 12 in the cuffs 4 to mate with the holes 22 in the high chair arms 20.

At one cuff, the handle 6 and the release mechanism of this invention are provided. At the opposite remaining cuff, the tray is secured simply by the cuff 4 and the peg 10. Both sides of the release mechanism operate via the single peg arm 8.

Figure 2:
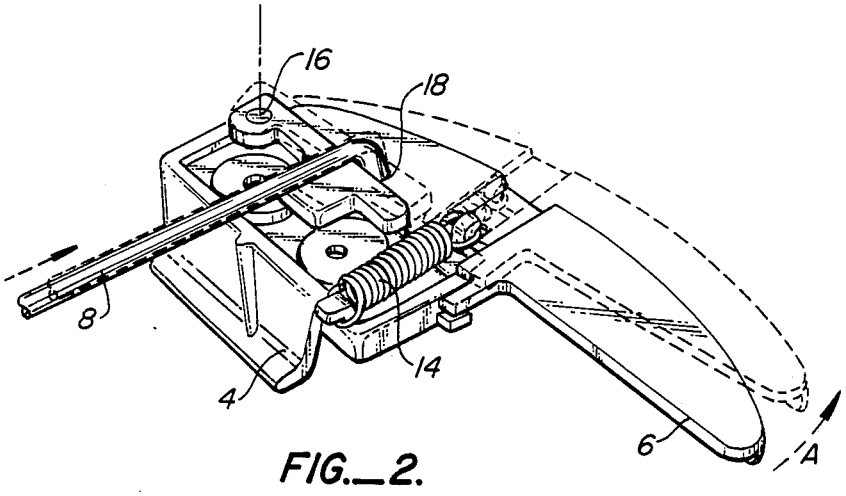
FIG. 2 is a close-up perspective illustration of the handle with the open position shown in broken lines.

When the tray is attached to the high chair, the release mechanism is in the closed position as shown in solid lines in FIG. 2. FIG. 2 illustrates an exploded view of a preferred embodiment of the release mechanism as it would be viewed by looking through the upper surface of tray 2.

A spring 14 is provided to bias the handle 6 towards the closed position. The handle 6 is pivotally connected to the cuff 4 at a fulcrum 16.

A slot 18 in the handle 6 accommodates the peg arm 8 and is sufficiently elongated to accommodate the arcuate movement of the handle 6 while the peg arm 8 is restricted to movement along its major axis.

After the peg arm 8 passes through the elongated slot 18 in the handle 6, it terminates in a peg 10 which passes through the hole 12 in the cuff 4.

Figure 3A:
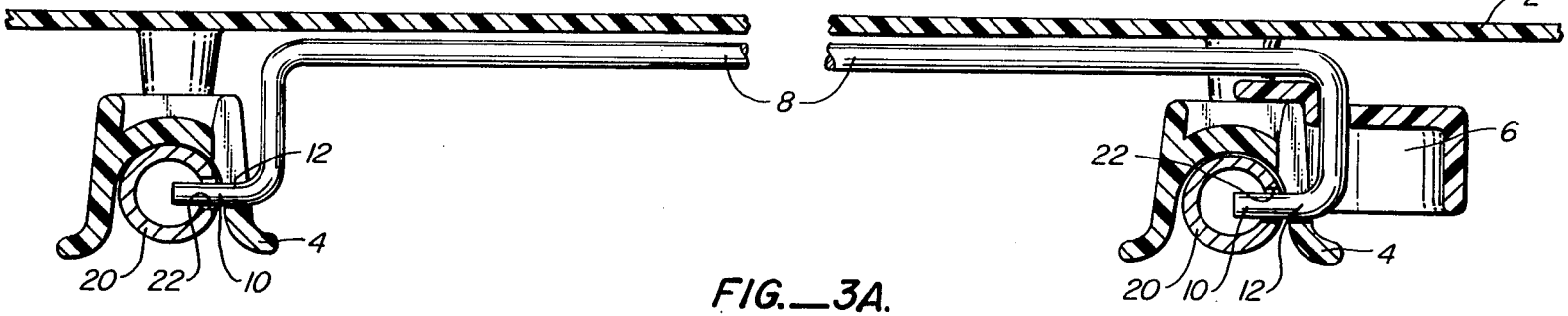
FIGS. 3A and 3B are sectional views taken along the section lines 3 shown in FIG. 1.
Figure 3B:
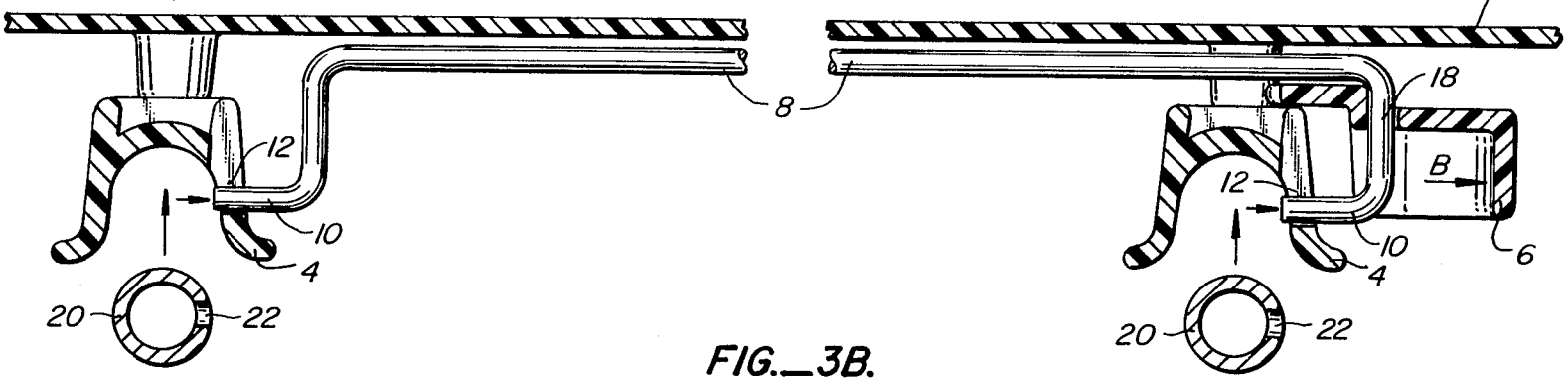

The manner in which the tray is engaged and disengaged from the chair arms is shown in FIGS. 3A and 3B. These sectional views are taken along the arrows marked 3 in FIG. 1. The view shown in FIG. 3A depicts the tray attached to the arms of the chair 20. The pegs 10 pass through the cuffs 4 at holes 12, then through the chair arms 20 at arm holes 22.

As the handle 6 is opened in the direction indicated by the arrow B of FIG. 3B, both pegs 10 are simultaneously and horizontally withdrawn from the arm holes 22 through the cuff holes 12 so that the tray 2 and release mechanism can be removed. As is shown in FIG.

3B, the pegs 10 need not be completely withdrawn from the cuffs 4.

It is of note that the only movement required to unlatch the tray from the chair is the horizontal movement of the peg arm 8 and the pegs 10 the short distance required to withdraw the pegs 10 from the holes 22 in the arms 20 of the chair.

What is claimed is:

1. A high chair tray release mechanism operable with one hand and for use with a high chair with a pair of arms having a series of symmetrically disposed holes along said pair of arms and a tray adapted to extend across the upper surface of said pair of arms, comprising:

a pair of cuffs fixed along the underside of said tray to accept said pair of high chair arms and having openings to mate with a pair of the holes provided in said pair of high chair arms;

a pair of horizontally translatable pegs to couple said tray to said high chair arms by extending through both the openings in said cuffs and the holes in said high chair arms;

means for coupling said pair of pegs, wherein said pair of pegs and said means for coupling said pair of pegs comprise a unitary element; and means for simultaneously retracting said pegs from engagement with the openings in said cuffs and the holes in said pair of arms.

2. The invention of claim 1, wherein said cuffs are constructed with a channel of a cross-section to accept the shape of said arms and of sufficient length to prevent the tray from tipping about an axis of rotation centered along the line connecting said pegs.

3. The invention of claim 1, wherein said unitary element comprises an elongated member spanning the distance between said cuffs and terminating at both ends in L-shaped fingers disposed in the same direction to form said pegs.

4. The invention of claim 1, wherein said means for simultaneously retracting said pegs from engagement with said cuffs and said arms comprises a handle connected to at least one of said pegs which accomplishes horizontal translation of said pegs.

5. The invention of claim 4, wherein said handle pivots about a pin located on one of said cuffs.

6. The invention of claim 4, wherein said handle has a slot through which an elongated member is threaded.

7. The invention of claim 4, wherein said handle is spring biased to extend said pegs through said openings in said cuffs and said holes in said arms while in the unstretched position.

* * * * *